US005670945A

United States Patent [19]

Applonie

[11] Patent Number: 5,670,945

[45] Date of Patent: Sep. 23, 1997

[54] SELF-MONITORING HAND-SANITIZING STATION

[76] Inventor: Alan R. Applonie, 853 N. 400 West, Centerville, Utah 84014

[21] Appl. No.: 715,883

[22] Filed: Sep. 19, 1996

Related U.S. Application Data

[63] Continuation-in-part of Ser. No. 498,742, Jul. 6, 1995, abandoned.

[51] Int. Cl.[6] ..... G08B 23/00

[52] U.S. Cl. ..... 340/573; 340/540; 340/541; 340/567; 4/619; 4/623; 422/105; 422/106; 422/116

[58] Field of Search ..... 340/540, 541, 340/573, 565, 552, 567; 307/112, 113, 116; 422/105, 106, 116; 4/619, 623

[56] References Cited

U.S. PATENT DOCUMENTS

| | | | |
|---|---|---|---|
| 4,817,651 | 4/1989 | Crisp et al. | 134/102 |
| 4,938,933 | 7/1990 | Perrot | 422/292 |
| 4,942,631 | 7/1990 | Rosa | 4/623 |
| 5,031,258 | 7/1991 | Shaw | 4/623 |

*Primary Examiner*—Jeffery Hofsass
*Assistant Examiner*—Benjamin C. Lee
*Attorney, Agent, or Firm*—Thompson E. Fehr

[57] ABSTRACT

A self-monitoring hand-sanitizing station having a basin capable of holding an antiseptic solution to be situated near the entrance to a food handling area. A first proximity detector determines when an individual is approaching both the basin and the entrance. The basin contains a first moisture-proof switch and a second moisture-proof switch the activation of which switches must be done simultaneously; these switches are so situated that a user cannot accomplish such simultaneous activation with a single hand. A second proximity detector determines when an individual has passed beyond the basin toward the entrance. And a logic unit receives electrical inputs from the first proximity detector, the second proximity detector, the first moisture-proof switch, and the second moisture-proof switch to determine when an individual has approached both the basin and the entrance but passed beyond the basin toward the entrance without having simultaneously activated the first moisture-proof switch and the second moisture-proof switch. When such a determination is made, an output signal is generated by the logic unit, which output signal activates an alarm.

15 Claims, 3 Drawing Sheets

SELF-MONITORING HAND-SANITIZING STATION

CROSS-REFERENCE TO RELATED APPLICATION

This is a continuation-in-part of copending U.S. application Ser. No. 08/498,742, filed on Jul. 6, 1995 now abandoned.

BACKGROUND OF THE INVENTION

1. Field of the Invention

This invention relates to a hand-sanitizing station, especially to a wash station suitable for use in commercial environments such as a restaurant kitchen or a food processing plant.

2. Description of the Related Art

Food processors and restaurants have a great interest in maintaining certain areas where food is handled relatively free of pathogenic microorganisms. Sanitizing workers' hands, particularly when a worker is entering the food handling area after a break or from using bathroom facilities, is a critical factor in effectively controlling such microorganisms.

If even one worker fails to sanitize his or her hands upon entering the food handling area, such conduct may well negate the efforts of all other workers who have been careful properly to sanitize their hands before beginning or resuming food handling. A contaminating microorganism brought into a food handling area by a single individual who failed properly to sanitize his or her hands may proliferate and be spread throughout the food handling area not only by the original unsanitary worker, but also by other workers who come into contact with surfaces which have been contaminated by the original worker.

There exist in all industries workers who simply are not concerned with public health. They may properly sanitize their hands when they are conscious that they are being observed, but they may fail to do so when they are not being monitored.

And even the most conscientious workers may occasionally forget properly to sanitize their hands before re-entering the food processing area. Once such a worker has entered the work area and made contact with any surface, it is too late for prevention of contamination. A thorough sanitizing of the entire food processing area and destruction of all food products in that area is then indicated. The resultant losses are economically costly.

Furthermore, many otherwise conscientious workers may discontinue properly to sanitize their hands prior to entering a work area if they have observed other workers not properly sanitizing their hands because such otherwise conscientious workers realize that their efforts would be in vain if not followed by all workers.

Currently, as a direct result of many highly publicized cases of widespread food-borne illnesses, there is great public awareness of food safety. Food contamination can result in severe illness and, in the case of the very young, elderly, or otherwise immunocompromised, even death may result. Consequently, many jurisdictions have enacted laws proscribing the failure properly to sanitize one's hands before touching commercial food products intended for sale to the public.

Some establishments have begun to pay an individual to monitor and ensure that proper sanitizing procedures are followed. However, employing an individual to monitor hand sanitizing is economically costly and may be ineffective. An individual being used to monitor hand sanitizing cannot be used in income-generating pursuits. If, on the other hand, such individual is used only intermittently to monitor hand sanitizing, the chance of improper hand sanitizing increases. But, even is such a person is continually present, such a monotonous task may produce periods of inattention.

Only a self-monitoring system can effectively minimize economic losses from the necessary destruction of worker-contaminated food products and lawsuits initiated by victims of food-borne illnesses caused by commercial food products.

Presently there are both patented an non-patented systems intended to address this problem.

Restaurants typically use an approved microbicidal soap at standard hand-washing stations.

U.S. Pat. No. 4,942,631 discloses a system that pumps sanitizing solution into a water pipe connected to a spray manifold of a faucet. And U.S. Pat. No. 4,999,929 covers a system which atomizes a mixture of sanitizing solution and water that is sprayed over a worker's hands.

None of the preceding technologies, however, monitor the use of their germ-fighting techniques. And, as suggested above, intentional avoidance and inadvertence on the part of workers contribute substantially to the risk of spreading food-borne illnesses.

Four United States patents have been granted for devices which partially address the problem of avoidance and inadvertence: U.S. Pat. No. 5,202,666 to Hermann Knippscheer; U.S. Pat. No. 4,606,085 to Joseph R. Davies; U.S. Pat. No. 4,688,585 to Helmut Vetter; and U.S. Pat. No. 5,199,118 to Charles K. Cole and Joseph A. Mitre.

The first three of these patented devices are very complex, though, and none effectively assures that an unintentional improper sanitizing of a worker's hands will be detected.

U.S. Pat. No. 5,202,666 employs a multitude of transmitters, receivers, and transducers as well as proximity detectors, switches, valves, and a computer to assure that water or soap has been dispensed or that a blower has been activated; but this does not guarantee that the water, soap, and air has been applied to the hands of a worker. Moreover, this system monitors only those individuals who are wearing a receiver and a transmitter, which are preferably contained within an identification badge. Therefore, if a worker who should be monitored inadvertently forgets to wear the badge or mistakenly wears the badge of a worker who does not need to be monitored, the system of U.S. Pat. No. 5,202,666 will not protect the food handling area from inadvertent contamination.

Complex electric timing circuitry combined with pumps and tubes enables the device of U.S. Pat. No. 4,606,085 to provide water, a cleanser, and a conditioning product for the hands of a user. This device, however, merely times certain cleansing as well as hand care actions and advises the user when such actions are occurring; it does not assure that water or a cleanser has been applied to the hands of a user. Furthermore, the device is not activated until a user initiates the flow of water; only then will an optional alarm be activated if the user leaves the wash basin before the timed cleansing cycles have been completed. Therefore, if a worker who should be monitored inadvertently fails to initiate the flow of water, the device of U.S. Pat. No. 4,606,085 will not indicate that such worker is about to enter a food handling area without having utilized the hand-sanitizing procedure.

A sophisticated means for detecting the shape and orientation of an object to be washed is combined with orientable nozzles and a programmable means for providing washing, rinsing, and drying fluids in particular patterns and quantities for specified periods of time to form the device of U.S. Pat. No. 4,688,585. This device signals the completion of a program of washing but does not activate a signal alerting anyone other than the user of a failure to complete such program, although it may preclude a door from opening to permit entry into a given area. There is, however, no explicit declaration that this device will assure that both hands of a user have been through the cleansing process. Moreover, two individuals could conceivably pass through the open door even though only one had utilized the cleansing device; there is no proximity detector for persons or objects outside the housing. Thus, again there is no safeguard against an inadvertent failure to use the device. The optional numeric code-input sensor or reader for identification cards is simply intended to assure that the desired program of washing for a given individual is employed if that individual elects to use the washer. Not only does it not detect a failure to use the device, but it is also subject to inadvertent use of the wrong code or the wrong identification card.

A simpler device is the subject of U.S. Pat. No. 5,199,118. A first sensor causes water and soap to be dispensed. A second sensor terminates the flow of water and operates a blower. "Each sensor is respectively activated by a user placing one or both of his or her hands in proximity to, but not in contact with, the respective sensors. . . . The water dispensing means may also be programmed such that it will remain activated for a minimum length of time, during which the second sensor is unable to deactivate the water dispensing means to insure that legal wash times are met." This device, however, only indicates that a wash cycle has been completed. It does not assure that the user's hands are kept under the soap and water, nor does it possess the ability to detect or warn if someone doesn't use it. It is, as stated above, only activated by a hand being placed in proximity to the sensors on the device; and it can be activated by the presence of just one hand. Therefore, as with the preceding devices, the device of U.S. Pat. No. 5,199,118 is incapable of protecting a food-handling area against inadvertent contamination.

SUMMARY OF THE INVENTION

The Self-monitoring Hand-sanitizing Station simply includes a basin capable of holding an antiseptic solution; two moisture-proof switches situated within the basin in such locations that these switches cannot be simultaneously activated with a single hand and that, when the basin contains antiseptic solution reaching at least to a predetermined level, a user's hand can only activate either of these moisture-proof switches when such hand is completely immersed in the antiseptic solution; a first proximity detector to determine when an individual is approaching both the basin and the entrance to a food-handling area; a second proximity detector to determine when an individual has passed beyond the basin toward the entrance to the food-handling area; a logic unit to determine that an individual has approached both the basin and the entrance but passed beyond the basin toward the entrance without having simultaneously activated the two moisture-proof switches; and an alarm that is activated by the logic unit when the logic unit has determined that an individual has approached both the basin and the entrance but passed beyond the basin toward the entrance without having simultaneously activated the two moisture-proof switches.

By placing the proximity detectors in such a position that there is no path an individual can use to reach the entrance to the food-handling area without having been detected by both the first proximity detector and the second proximity detector and by periodically assuring that the basin has been filled with the antiseptic solution, the Self-monitoring Hand-sanitizing Station assures that no one can inadvertently enter the food-handling area without having sanitized his or her hands.

Moreover, the Self-monitoring Hand-sanitizing Station can be constructed with a small number of relatively inexpensive components and can function with little human intervention.

DESCRIPTION OF THE PREFERRED EMBODIMENT

Figure 1:
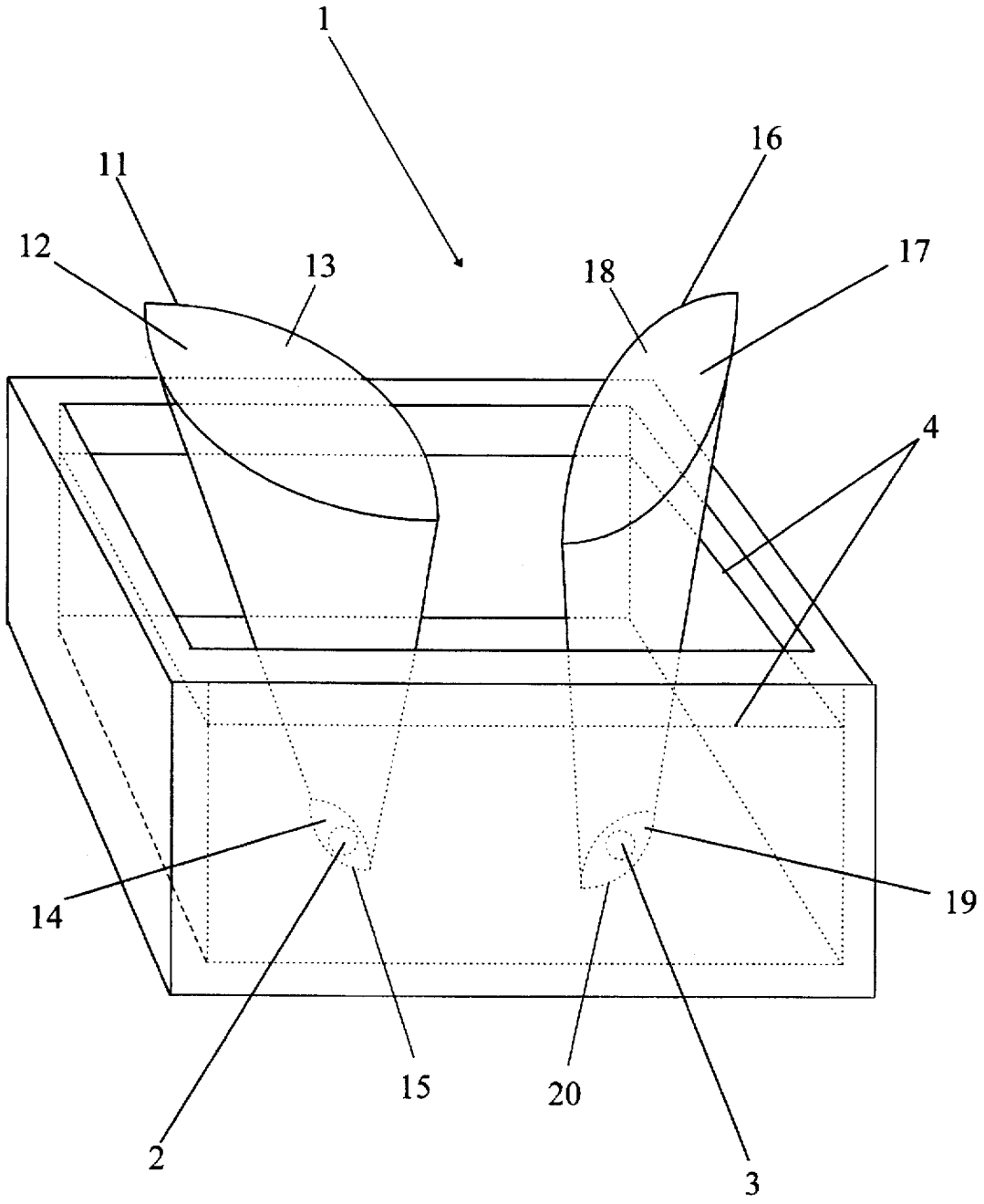
FIG. 1 illustrates the basin of the Self-monitoring Hand-sanitizing Station.

The Self-monitoring Hand-sanitizing Station has, as shown in FIG. 1, a basin 1 capable of holding an antiseptic solution.

A first moisture-proof switch 2 and a second moisture-proof switch 3 are situated within the basin 1 in such locations that the first moisture-proof switch 2 and the second moisture-proof switch 3 cannot be simultaneously activated with a single hand and that, when the basin 1 contains antiseptic solution reaching at least to a predetermined level 4, a user's hand can only activate either the first moisture-proof switch 2 or the second moisture-proof switch 3 when such hand is completely immersed in the antiseptic solution.

Figure 2:
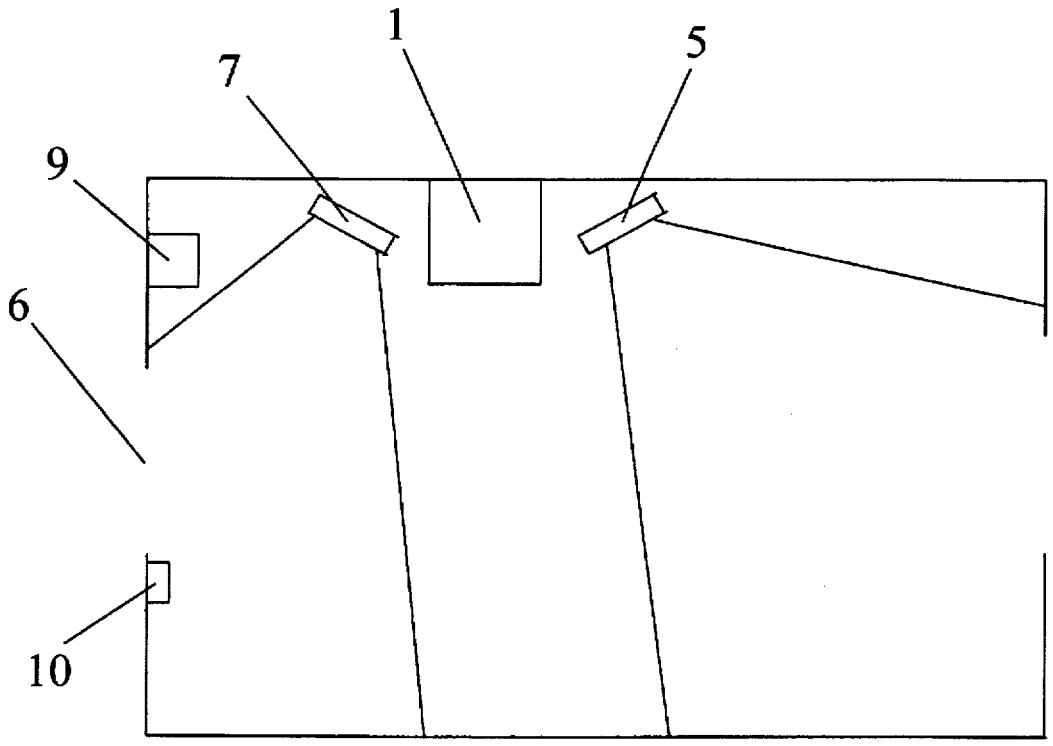
FIG. 2 shows the placement of the Self-monitoring Hand-sanitizing Station within a room.

A first proximity detector 5 is oriented, as depicted in FIG. 2, to determine when an individual is approaching both the basin 1 and the entrance 6 to a food-handling area and to assure that there is no path an individual can use to reach the entrance to the food-handling area without having been detected by the first proximity detector 5. Similarly, a second proximity detector 7 is oriented to determine when an individual has passed beyond the basin toward the entrance to the food-handling area and to assure that there is no path an individual can use to reach the entrance to the food-handling area without having been detected by the second proximity detector 7.

Figure 3:
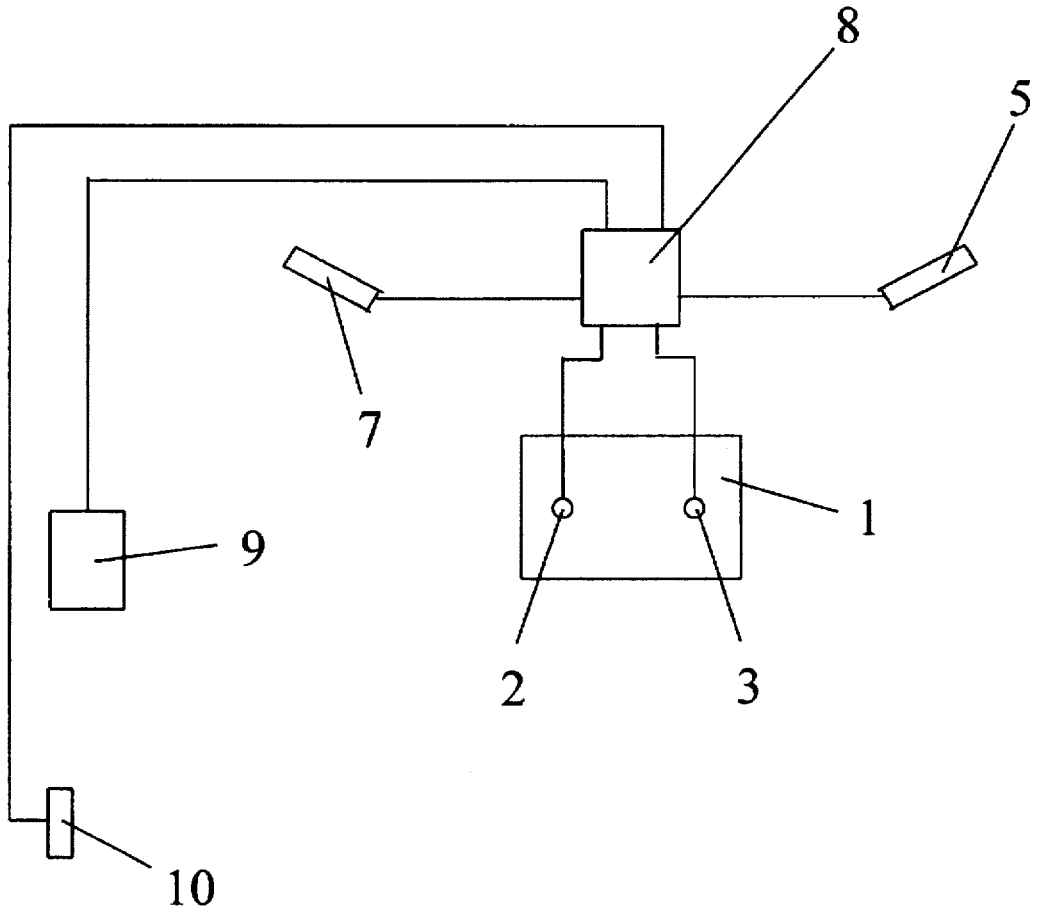
FIG. 3 portrays the electrical connections among components of the Self-monitoring Hand-sanitizing Station.

A logic unit 8 is electronically connected, as portrayed in FIG. 3, to receive electrical inputs from the first proximity detector 5, the second proximity detector 7, the first moisture-proof switch 2, and the second moisture-proof switch 3. Using techniques which are well known in the art, the logic unit 8 determines when an individual has approached both the basin 1 and the entrance 6 but passed beyond the basin 1 toward the entrance 6 without having simultaneously activated the first moisture-proof switch 2 and the second moisture-proof switch 3 and then produces an output signal. An alarm 9 is electrically connected to receive the output signal from the logic unit 8 and to be activated by such output signal.

The first moisture-proof switch 2 and the second moisture-proof switch 3 are preferably mechanical switches but could be any switch the state of which is changed by the presence of a human hand.

The first proximity detector 5 and the second proximity detector 7 are preferably passive infrared detectors, i.e., detectors which detect heat from a source such as a human being as well as movement of such human being but can be any device which detects movement of a person, such as an ultrasonic detector; a pressure-sensitive foot pad; a turnstile; a combination of a laser beam and a receptor that would be activated when the laser beam is interrupted; a combination of an infrared beam other than from a laser and a receptor that would be activated when the infrared beam is interrupted, i.e., an active infrared detector; and a combination of a visible light beam generated other than by a laser and a receptor that would be activated when the light beam is interrupted.

The alarm 9 preferably produces an audio signal but could produce any signal which may be detected by human senses, such as a visual indication. If desired, the output signal from the logic unit 8 could alternatively be used to activate a lock 10 to preclude the opening of a door in the entrance 6 or could both activate the alarm 9 and preclude the opening of a door in the entrance 6.

Optionally, further to assure that both hands are immersed in the antiseptic solution, a first sleeve 11 is attached to the basin 1. A first aperture 12 at a first end 13 of the first sleeve 11 allows a first hand and arm of a user to be inserted into the first sleeve 11. A second aperture 14 at the second end 15 of the first sleeve 11 permits the fingertips of the user's first hand to approach and activate only the first moisture-proof switch 2. Similarly, a second sleeve 16 is attached to the basin 1. A first aperture 17 at a first end 18 of the second sleeve 16 allows a second hand and arm of a user to be inserted into the second sleeve 16. A second aperture 19 at the second end 20 of the second sleeve 16 permits the fingertips of the user's second to approach and activate only the second moisture-proof switch 3.

I claim:

1. A self-monitoring hand-sanitizing station, which comprises:

a basin capable of holding an antiseptic solution;

a first moisture-proof switch situated within the basin such that when the basin contains antiseptic solution reaching at least to a predetermined level, a user's hand can only activate the first moisture-proof switch when such hand is completely immersed in the antiseptic solution;

a second moisture-proof switch situated within the basin in such a location that the first moisture-proof switch and the second moisture-proof switch cannot be simultaneously activated with a single hand and such that when the basin contains antiseptic solution reaching at least to a predetermined level, a user's hand can only activate the second moisture-proof switch when such hand is completely immersed in the antiseptic solution;

a first proximity detector to be oriented to determine when an individual is approaching both the basin and an entrance to a food-handling area and to assure that there is no path an individual can use to reach the entrance to the food-handling area without having been detected by said first proximity detector;

a second proximity detector to be oriented to determine when an individual has passed beyond the basin toward the entrance to the food-handling area and to assure that there is no path an individual can use to reach the entrance to the food-handling area without having been detected by the second proximity detector; and a logic unit which is electronically connected to receive electrical inputs from the first proximity detector, the second proximity detector, the first moisture-proof switch, and the second moisture-proof switch and to use such inputs to determine when an individual has approached both the basin and the entrance but passed beyond the basin toward the entrance without having simultaneously activated the first moisture-proof switch and the second moisture-proof switch as well as to produce an output signal when the determination has been made that an individual has approached both the basin and the entrance but passed beyond basin toward the entrance.

2. The self-monitoring hand-sanitizing station as recited in claim 1, further comprising:

an alarm which is electrically connected to receive the output signal from the logic unit and to be activated by such output signal.

3. The self-monitoring hand-sanitizing station as recited in claim 2, wherein:

the first proximity detector is a passive infrared detector; and the second proximity detector is a passive infrared detector.

4. The self-monitoring hand-sanitizing station as recited in claim 2, wherein:

the first proximity detector is an ultrasonic detector; and the second proximity detector is an ultrasonic detector.

5. The self-monitoring hand-sanitizing station as recited in claim 1, further comprising:

a lock which is electrically connected to receive the output signal from the logic unit and to be activated by such output signal.

6. The self-monitoring hand-sanitizing station as recited in claim 5, wherein:

the first proximity detector is a passive infrared detector; and the second proximity detector is a passive infrared detector.

7. The self-monitoring hand-sanitizing station as recited in claim 5, wherein:

the first proximity detector is an ultrasonic detector; and the second proximity detector is an ultrasonic detector.

8. The self-monitoring hand-sanitizing station as recited in claim 1, further comprising:

a first sleeve attached to the basin, which first sleeve has a first aperture that allows a first hand and arm of a user to be inserted into said first sleeve and which first sleeve has a second aperture that permits the fingertips of the user's first hand to approach and activate only the first moisture-proof switch; and a second sleeve attached to the basin, which second sleeve has a first aperture that allows a second hand and arm of a user to be inserted into said second sleeve and which second sleeve has a second aperture that permits the fingertips of the user's second hand to approach and activate only the second moisture-proof switch.

9. The self-monitoring hand-sanitizing station as recited in claim 8, further comprising:

an alarm which is electrically connected to receive the output signal from the logic unit and to be activated by such output signal.

10. The self-monitoring hand-sanitizing station as recited in claim 9, wherein:

the first proximity detector is a passive infrared detector; and the second proximity detector is a passive infrared detector.

11. The self-monitoring hand-sanitizing station as recited in claim 9, wherein:

the first proximity detector is an ultrasonic detector; and the second proximity detector is an ultrasonic detector.

12. The self-monitoring hand-sanitizing station as recited in claim 8, further comprising:

a lock which is electrically connected to receive the output signal from the logic unit and to be activated by such output signal.

13. The self-monitoring hand-sanitizing station as recited in claim 12, wherein:

the first proximity detector is a passive infrared detector; and the second proximity detector is a passive infrared detector.

14. The self-monitoring hand-sanitizing station as recited in claim 12, wherein:

the first proximity detector is an ultrasonic detector; and the second proximity detector is an ultrasonic detector.

15. A process for monitoring the sanitizing of hands, which comprises:

providing a basin capable of holding an antiseptic solution;

attaching a first moisture-proof switch within and to the basin such that when the basin contains antiseptic solution reaching at least to a predetermined level, a user's hand can only activate the first moisture-proof switch when such hand is completely immersed in the antiseptic solution;

attaching a second moisture-proof switch within and to the basin in such a location that the first moisture-proof switch and the second moisture-proof switch cannot be simultaneously activated with a single hand and such that when the basin contains antiseptic solution reaching at least to a predetermined level, a user's hand can only activate the second moisture-proof switch when such hand is completely immersed in the antiseptic solution;

orienting a first proximity detector to determine when an individual is approaching both the basin and an entrance to a food-handling area and to assure that there is no path an individual can use to reach the entrance to the food-handling area without having been detected by said first proximity detector;

orienting a second proximity detector to determine when an individual has passed beyond the basin toward the entrance to the food-handling area and to assure that there is no path an individual can use to reach the entrance to the food-handling area without having been detected by the second proximity detector; and electronically connecting a logic unit to receive electrical inputs from the first proximity detector, the second proximity detector, the first moisture-proof switch, and the second moisture-proof switch and to use such inputs to determine when an individual has approached both the basin and the entrance but passed beyond the basin toward the entrance without having simultaneously activated the first moisture-proof switch and the second moisture-proof switch as well as to produce an output signal when the determination has been made that an individual has approached both the basin and the entrance but passed beyond basin toward the entrance.

* * * * *